United States Patent [19]

Yamanoi et al.

[11] Patent Number: 4,860,568

[45] Date of Patent: Aug. 29, 1989

[54] TUBULAR MATERIAL DRAWING APPARATUS FOR MANUFACTURING PRECISION TUBE

[75] Inventors: Tukio Yamanoi; Mitsuo Kandachi; Masahiro Iwata; Kazumi Kato, all of Oyama, Japan

[73] Assignee: Furukawa Aluminum Co., Ltd., Tokyo, Japan

[21] Appl. No.: 184,368

[22] Filed: Apr. 21, 1988

[30] Foreign Application Priority Data

Jul. 27, 1987 [JP] Japan ..... 62-187443
Jul. 27, 1987 [JP] Japan ..... 62-187444

[51] Int. Cl.[4] ..... B21C 1/24
[52] U.S. Cl. ..... 72/291; 72/283
[58] Field of Search ..... 72/283, 291, 274, 287, 72/420

[56] References Cited

U.S. PATENT DOCUMENTS

| | | | |
|---|---|---|---|
| 2,264,688 | 12/1941 | Wolf | 72/291 |
| 2,492,876 | 12/1949 | McIlvried et al. | 72/283 |
| 2,536,637 | 1/1951 | Garwig | 72/283 |
| 2,764,279 | 9/1956 | Kerr | 72/283 |

*Primary Examiner*—Daniel C. Crane
*Attorney, Agent, or Firm*—Frishauf, Holtz, Goodman & Woodward

[57] ABSTRACT

A tubular material drawing apparatus for manufacturing precision tubes comprises a plug set device, provided to a back bench, for holding a plug rod in a horizontal state, a travel base to be movable backward with respect to the back bench in a horizontal direction, a holding mechanism, provided to the travel base and capable of holding a rear end portion of a tube element, for holding the rear end portion of the tube element and moving the tube element in a horizontal direction to fit the tube element on the plug rod upon movement of the travel base, a clamp, movably provided to the travel base in a horizontal direction, holding the rear end portion of the tube element and then bringing the rear end portion to the holding mechanism, a carriage guide horizontally extending, a carriage which is guided by the carriage guide and is movable forward, die provided between the back bench and the carriage, and a chuck portion, provided to the carriage and capable of holding a front end portion of the tube element. The chuck portion, die, and holding mechanism are arranged to be coaxially positioned, for holding the front end portion of the tube element while the holding mechanism holds the front end portion of the tube element in which the plug rod is inserted, and while the carriage is moved forward, thereby allowing the die to draw the tube element.

10 Claims, 7 Drawing Sheets

TUBULAR MATERIAL DRAWING APPARATUS FOR MANUFACTURING PRECISION TUBE

BACKGROUND OF THE INVENTION

1. Field of the Invention

The present invention relates to a tubular material for manufacturing a precision-tube drawing apparatus comprising a drawing bench for drawing a tubular material (round tube, angular tube, deformed or profile tube) and, more particularly, to an apparatus for manufacturing a drawn precision-tube which has high dimensional precisions (bending, twisting, roundness (in the case of a round tube), nonuniform section) and high surface precision.

2. Description of the Related Art In a conventional drawing bench, a back bench having a plug set device for reciprocating a plug rod while a rear end of the plug rod is held at a drawing core, and carriage rails having a die stand with a die fixed at its rear end portion in a drawing direction are arranged in tandem. After a tube element is fitted on a plug and the plug rod, the front end of the tube element is guided to the die, and the plug is moved forward to be guided to the distal end of the tube element. Thereafter, the tube element is chucked and drawn by a car carriage traveling along the carriage rails.

In the conventional drawing bench described above, the tube element which is fitted on the plug and the plug rod is held by only the plug rod before drawing. For this reason, when the distal end of the tube element is set in the die, the plug rod receiving the weight of the tube element is flexed, and during drawing, the central line of the tube element cannot coincide with the drawing central line. During drawing, the rear end of the tube element is unstable and is vibrated more or less, thus degrading dimensional precisions, e.g., causing a nonuniform section or bending of a drawn tube.

Since the conventional carriage is of car type, it is easily vibrated during drawing travel, and this also causes a nonuniform section and bending of a product. With such a drawing bench, the surface of the drawn tube is easily scratched or indented.

Therefore, when the drawn tube is used for a precision part such as a photosensitive drum of a copying machine and a magnetic drum, bending of the drawn tube must be corrected by a roller, and its surface must be ground.

SUMMARY OF THE INVENTION

It is an object of the present invention to provide a tubular material drawing apparatus for manufacturing precision-tubes comprising a drawing bench free from the conventional drawbacks, and can manufacture a drawn tube which has high dimensional precisions (i.e., is free from bending and a nonuniform section, and has high roundness in the case of a round rod), and has high surface precisions (i.e., is free from indentation and scratching).

In an aspect of the invention, a tubular material drawing apparatus for manufacturing precision-tubes comprises a back bench having guide means with an axis, a plug set device, provided to said back bench, for holding a plug rod to be parallel to said axis, a travel base guided by said guide means to be movable backward with respect to said back bench along said axis, first holding means, provided to said travel base and capable of holding a rear end portion of a tube element, for holding the rear end portion of the tube element and moving the tube element to be parallel to said axis to fit the tube element on said plug rod upon movement of said travel base, second holding means, movably provided to said travel base to be parallel to said axis and capable of holding the rear end portion of the tube element, for holding the rear end portion of the tube element and bringing the rear end portion to said first holding means, carriage guide means extending along said axis, a carriage which is guided by said carriage guide means along said axis and is movable forward, die means provided between said back bench and said carriage, and third holding means, provided to said carriage and capable of holding a front end portion of the tube element, said third holding means, a die, and said first holding means being arranged to be coaxially positioned, for holding the front end portion of the tube element while said first holding means holds the front end portion of the tube element in which said plug rod is inserted, and while said carriage is moved forward, thereby allowing said die to draw the tube element.

In the other aspect of the invention, a drawing method for manufacturing precision-tubes comprises the steps of, holding a plug rod in a horizontal direction, holding a rear end portion of a tube element by first holding means and moving the tube element in a horizontal direction to fit the tube element on the plug rod, while the plug rod and tube element are kept in a horizontal state, holding the rear end portion of the tube element in which the plug rod is fitted, by second holding means, and moving the second holding means so that it is arranged in coaxial state with a die and third holding means, and holding a front end portion of the tube element by the third holding means and moving the third holding means in a forward and horizontal direction thereby allowing said die to draw the precision tube element.

DETAILED DESCRIPTION OF THE PREFERRED EMBODIMENTS

A preferred embodiment of the present invention will be described hereinafter with reference to the accompanying drawings.

Figure 1:
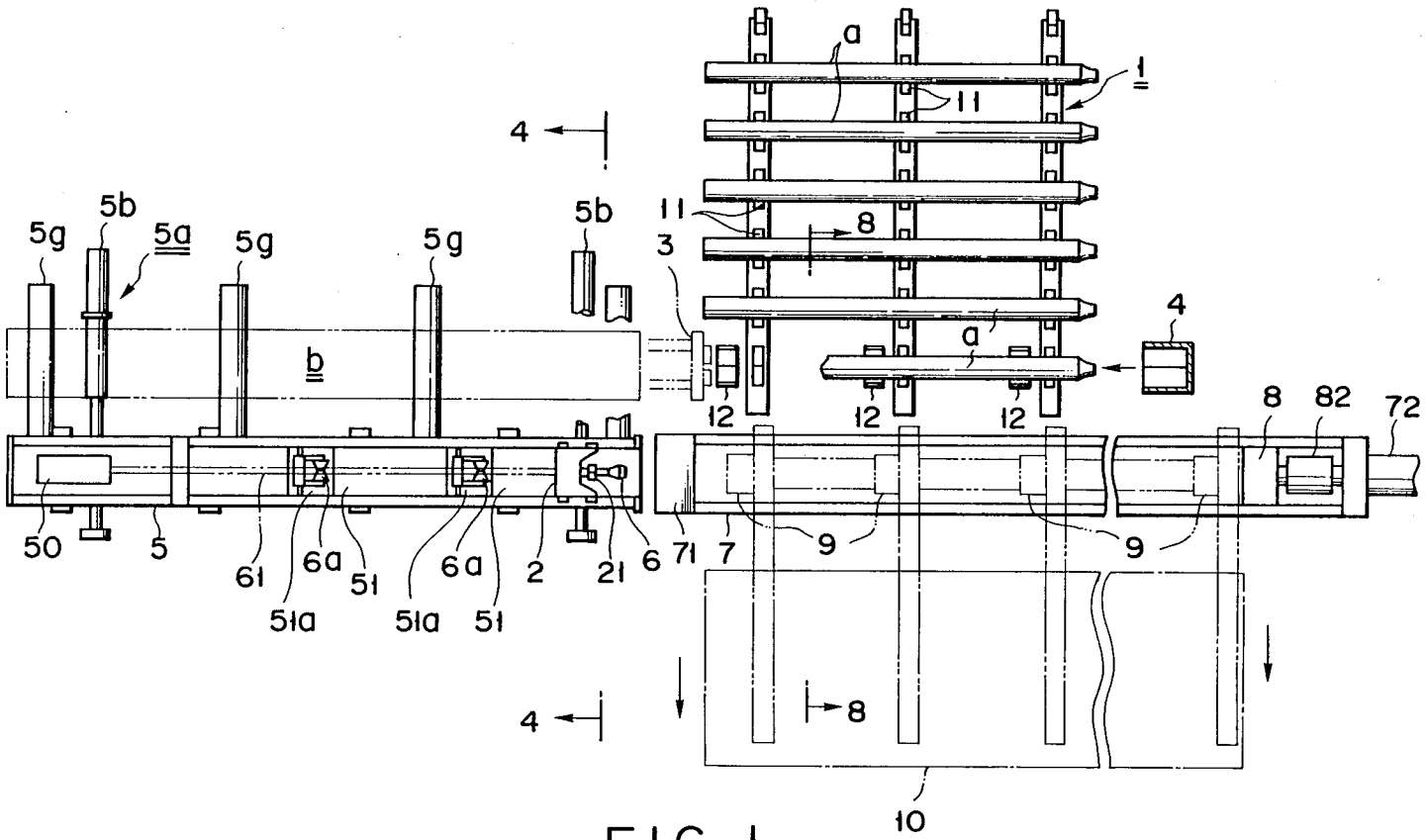
FIG. 1 is a schematic plan view showing the entire tubular material drawing apparatus for manufacturing precision-tubes according to an embodiment of the present invention.

FIG. 1 is a schematic plan view of a tubular material precision-drawing system using a drawing bench according to the present invention. Reference numeral 1 denotes a tube element feed conveyor; 12, a lifter for lifting tube element a to a predetermined level; 3, a clamp for appropriately holding tube element a; 4, a tube element pusher; 5, a back bench; 7, a carriage rail arranged in tandem with back bench 5; and 8, a carriage.

Feed conveyor 1 for tube element a has V-shaped tube element receptacles 11 which are disposed at equal A cushion member (not shown) of a porous material is adhered to the inner surface of each receptacle 11. A similar cushion member is also adhered to the upper surface of lifter 12 and a portion of pusher 4 contacting tube element a.

Tube elements a are intermittently fed to a position in front of tube element fitting position b for plug 6 (to be described later) in synchronism with a drawing cycle while they are horizontally supported by a plurality of receptacles 11 aligned in the widthwise direction of feed conveyor 1.

In back bench 5 of this embodiment, plug 6 is fixed to the distal end of plug rod 61, and the rear end of plug rod 61 is held and horizontally supported by plug set device 50 provided to the rear end portion of bench 5 at the level of the drawing core at an original position indicated by a solid line in FIG. 1. In this state, back bench 5 is moved to tube element fitting position b as shown by two-dots dash lines. Plug set device 50 has a function of moving plug rod 61 toward a die fixed in die stand 71, as will be described later.

In this embodiment, back bench 5 is arranged as described below, and is moved toward fitting position b by horizontal movement. After tube element a is fitted on plug 6 and plug rod 61, back bench 5 is returned to the original position.

Figure 2:
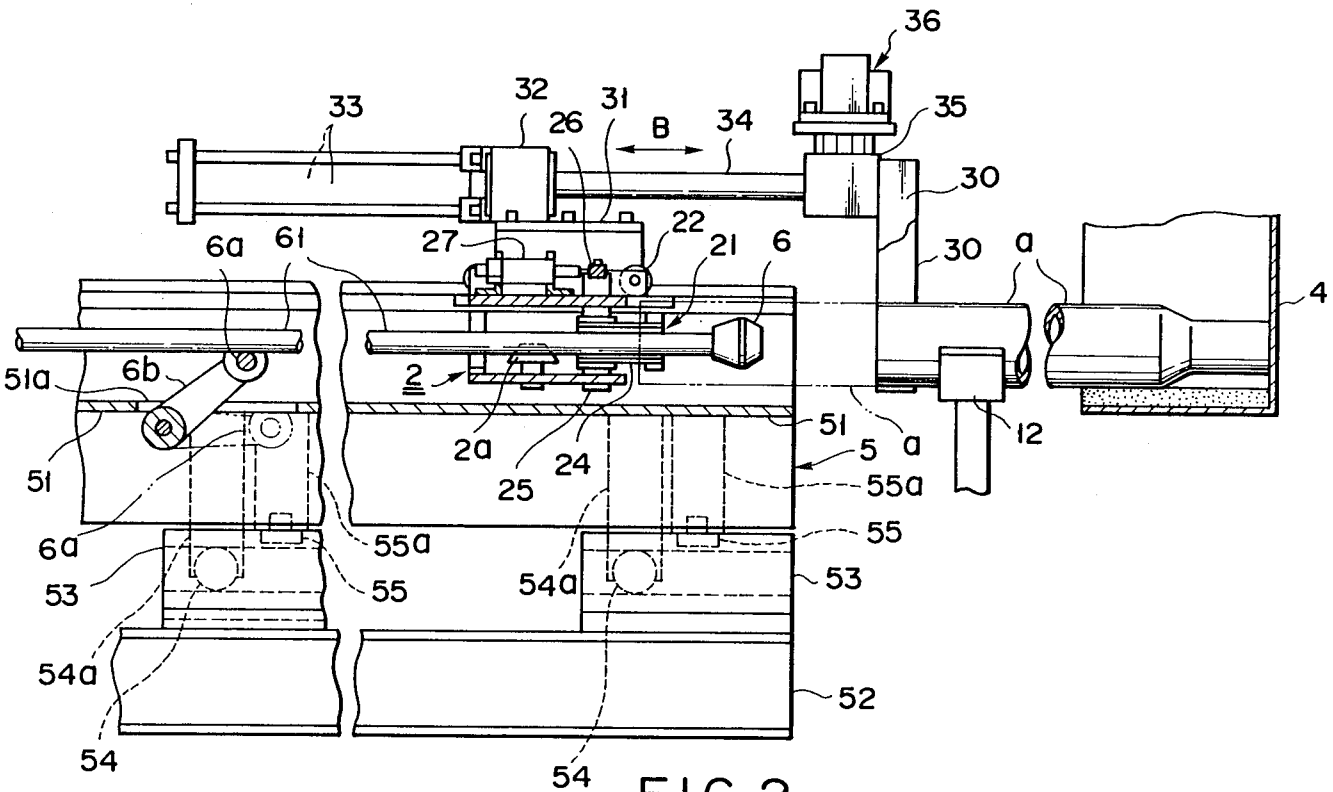
FIG. 2 is a partial sectional view of the drawing apparatus showing a state wherein a tube element is fitted on a plug and a plug rod.
Figure 3:
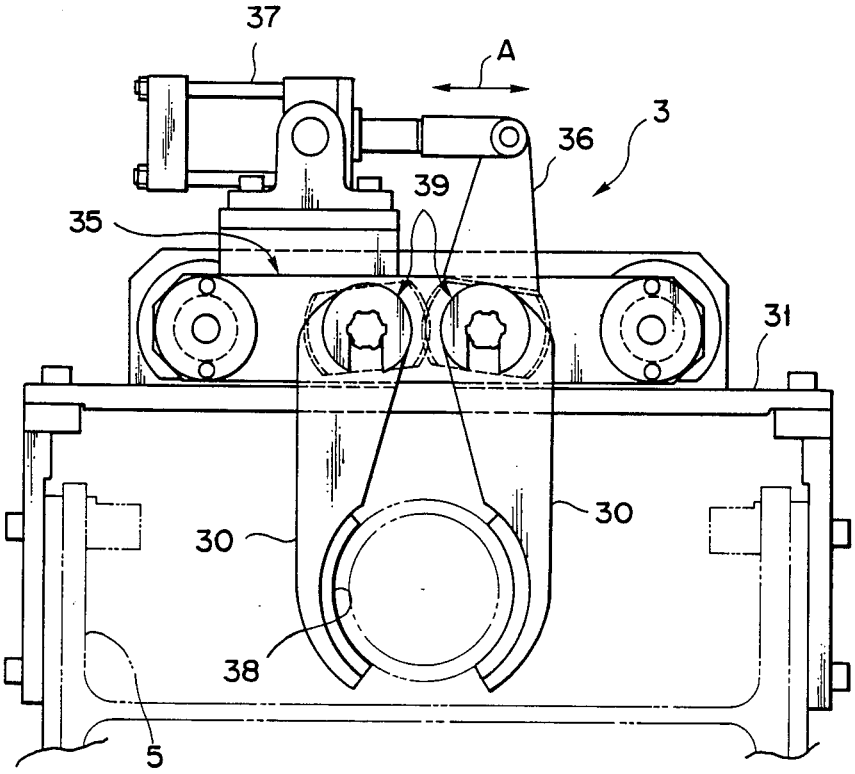
FIG. 3 is a front view showing a clamp of the drawing apparatus.

Back bench 5 has H-shaped frame 105 having middle bottom 51, as shown in FIGS. 2 and 3. An appropriate number of travel rollers 54 which are rotatable about horizontal axes are mounted on the lower portions of an appropriate number of mounting arms 54*a* which are fixed at two sides of the frame at predetermined intervals. Rollers 54 are brought into rolling contact with the outer horizontal surfaces of a pair of tracks 53 fixed at a predetermined interval therebetween on the two upper surface edge portions of bench base 52 along its longitudinal direction. Vibration prevention rollers 55 which are rotatable about vertical axes are mounted on the lower portions of an appropriate number of mounting arms 55*a* which are fixed to the side surfaces of frame 105. Rollers 55 are brought into rolling contact with the vertical surfaces of tracks 53, so that back bench 5 can travel along tracks 53 without being vibrated horizontally and vertically.

Back bench 5 is moved to or returned from fitting position b along base 5*c* by moving device 5*a*. Moving device 5*a* has hydraulic cylinder 5*b* fixed on base 5*c*. The distal end of the drive shaft of hydraulic cylinder 5*b* is coupled to bench base 52 of back bench 5. Two pairs of wheels 5*f* are rotatably supported at two lower side portions of bench base 52. Wheels 5*f* are located on a pair of guide rails fixed on base 5*c*. When hydraulic cylinder 5*b* is driven, back bench 5 is guided along the guide rails by wheels 5*f* to allow reciprocal motion. Rack 5*d* extending along the guide rails is fixed on base 5*c*, and pinion 5*e* meshing with rack 5*d* is rotatably supported at the central lower end portion of the bench base. Thus, vibration upon traveling of back bench 5 is prevented by the rack-pinion mechanism. Reference numeral 5*g* denotes a cable bear, one end of which is connected to back bench 5 and the other end of which is connected to base 5*c*. Pipes and wirings for supplying a hydraulic pressure and electric power to back bench 5 are housed in cable bear 5*g*.

As shown in FIGS. 1 and 2, a plurality of window holes 51*a* are formed at equal intervals in the back-and-forth direction in middle bottom 51 of the frame of back bench 5. Support member 6*a* projects upward from each window hole 51*a*. Each support member 6*a* comprises a roller which is mounted on the distal end of arm 6*b*, whose proximal end is pivotally supported on the frame of bench 5. Support members 6*a* substantially horizontally support plug rod 61 at a plurality of positions from below so that plug rod 61 is not flexed. When a tube element is fitted on plug rod 61 and comes closer to support members 6*a*, support members 6*a* are moved downward or escaped in a state indicated by an alternate long and two short dashed line in FIG. 2 so as not to disturb passage of the tube element.

When back bench 5 is moved to fitting position b while it substantially horizontally supports plug rod 61, tube element a located in front of moved back bench 5 is simultaneously lifted up by lifters 12 to a level suitable for fitting on plug rod 61 and plug 6, as shown in FIG. 2. At the same time, the rear end portion of tube element a (the rear end portion in the drawing direction of a tubular material) is clamped by clamp 3. Clamp 3 can be reciprocal along back bench 5, and is moved together with bench 5. When clamp 3 clamps tube element a, lifters 12 are moved downward and is separated from tube element a.

In this embodiment, clamp 3 for clamping tube element a has base plate 31, the two end portions of which are supported on the two upper surface edge portions of back bench 5, as shown in FIG. 3. A pair of pneumatic cylinders 33 (only one is illustrated in FIG. 2) are fixed parallel to each other on base plate 31, as shown in FIG. 2. Movable base 35 is fixed to the distal end of drive shafts 34 of pneumatic cylinders 33. As a result, movable base 35 is movable by cylinders 33 in direction B in FIG. 2. Hydraulic cylinders 37 are fixed on movable plate 35, and a pair of gears 39 which are meshed with each other are pivotally supported at side surfaces of plate 35. One gear 39 is coupled pivotally together to the other end of pivotal lever 36. One end of pivotal lever 36 is axially supported at the distal end of the drive shaft of hydraulic cylinders 37. The upper ends of a pair of clamp arms 30 are pivotally coupled to these gears 39. Arcuated recess portions having substantially the same curvature as that of the outer surface of tube element are formed in opposing surfaces of the lower portions of clamp arms 30. Cushion members 38 are attached to the inner surfaces of these recess portions so as to protect tube element a. In clamp 3 with the above structure, when hydraulic cylinders 37 are driven, clamp arms 30 can be opened/closed through lever 36 and gears 39, and tube element a can be clamped and released between cushion members 38. When preumatic cylinders 33 are driven, clamp arms 30 can be moved in the back-and-forth direction with respect to back bench 5.

After clamp 3 holds the rear end portion of tube element a, it is moved backward to a position of tube end holding mechanism 21 of travel base 2 (to be described below) along back bench 5 by preumatic cylinders 33 so as to fit the rear end portion of tube element a on plug 6 and to guide it to holding mechanism 21. Holding mechanism 21 holds the rear end portion of tube element a. When clamp 3 holds the rear end portion of tube element a, tube element pusher 4 is moved backward to support the front end portion of tube element a, as shown in FIG. 2.

Figure 4:
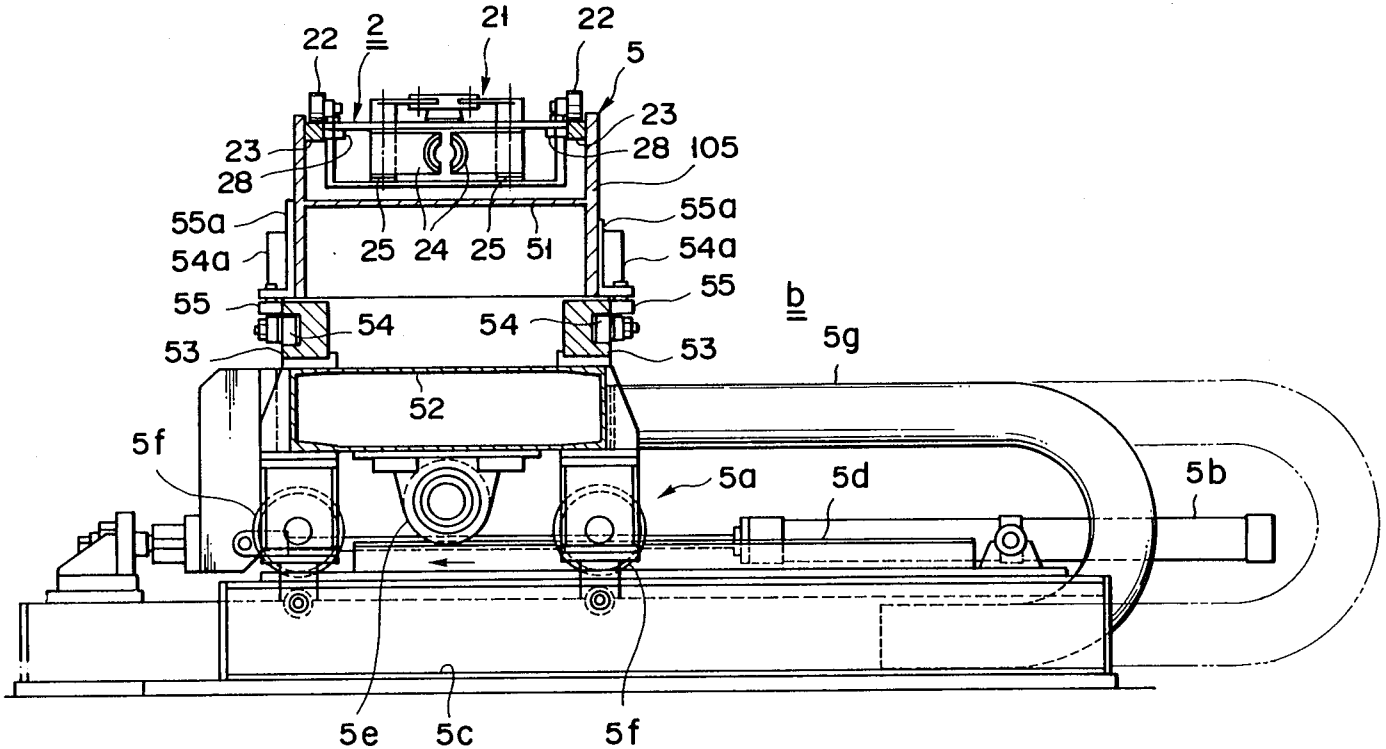
FIG. 4 is a sectional view taken along a line 4—4 in FIG. 1.
Figure 5:
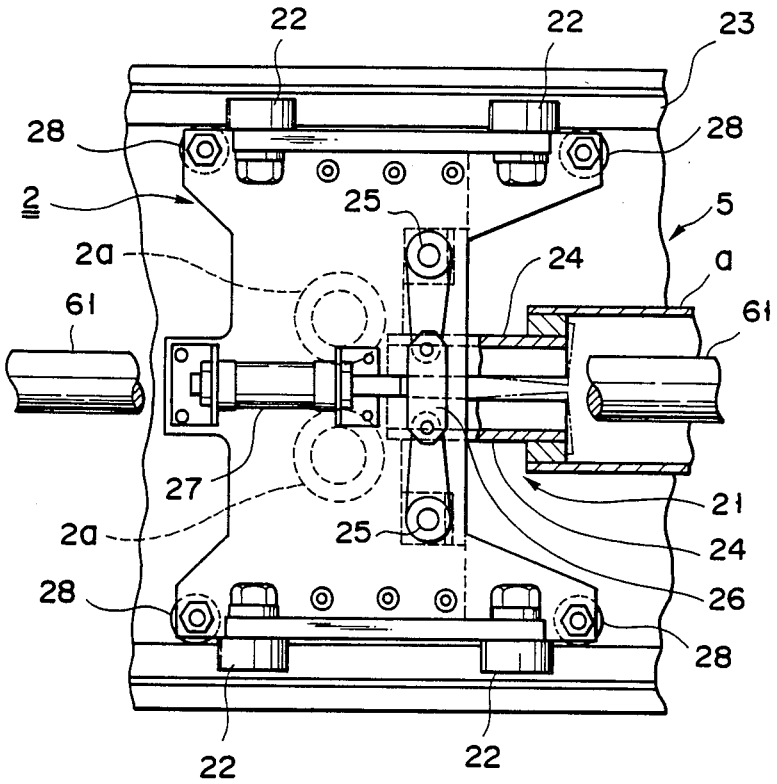
FIG. 5 is a sectional view showing a travel base provided to a back bench of the drawing apparatus.

Travel base 2 has, at its front end central portion, tube end holding mechanism 21 for holding the end portion of tube element a at the level of the drawing core. Two pairs of travel rollers 22 are mounted on the two upper side portions of the frame and are rotatable about horizontal shafts (FIGS. 4 and 5). These rollers 22 are in rolling contact with the horizontal upper surfaces of a pair of rails 23 formed inside the upper end portion of back bench 5. In addition, two pairs of vibration prevention rollers 28 are mounted near rollers 22 and are rotatable about the vertical axes. These rollers 28 are in rolling contact with the inner vertical surfaces of rails 23. Thus, travel base 2 can be desirably moved in the back-and-forth direction along back bench 5 so as not to be vibrated. Travel base 5 has no self-running mechanism.

In holding mechanism 21 of this embodiment, as shown in FIGS. 4 and 5, a pair of opposing chuck segments 24 having an arcuated section are respectively fixed to shafts 25. Shafts 25 are pivoted through link 26 by pneumatic cylinder 27 to widen an interval between chuck segments 24, so that an end portion of tube element a is held from inside by the frictional forces of the outer surfaces of segments 24. Holding mechanism 21 can have a structure such that the end portion of tube element a is externally clamped like a conventional clamp. Alternatively, it may have a structure such that the rear end of tube element a is chucked by a separate chucking means, and after drawing, the chucking means releases the end portion of the tube element. The central opening of each chuck segment 24 serves to support the front portion of plug rod 61.

As shown in FIGS. 2 and 5, umbrella-like roller support members 2*a* which are separated from each other in the lateral direction are provided to the rear end of travel base 2, and plug rod 61 is clamped by the inclined peripheral surfaces of support members 2*a*.

When holding mechanism 21 holds the end portion of tube element a, clamp 3 opens a pair of clamp arms 30 to release tube element a. Then, pusher 4 which supports the front end of tube element a at the same level as that of holding mechanism 21 pushes tube element a to the left in FIG. 2 to horizontally move it. As a result, travel base 2 is moved backward while holding the front end portion of tube element a, and fits tube element a until plug 6 reaches the front end of tube element a. During this interval, tube element a is supported only by holding mechanism 21 of travel base 2 and pusher 4.

After tube element a is fitted on plug rod 61, clamp 3 clamps tube element a again, and thereafter, pusher 4 is returned to the original position shown in FIG. 1 (tube element a is supported by holding mechanism 21 and clamp 3). At the same time, back bench 5 is returned to the original position illustrated by the solid line in FIG. 1. Since plug rod 61 is horizontally supported at the level of the drawing core of the die on back bench 5 before the tube element is fitted thereon, tube element a can be precisely aligned with the drawing core of the die at the same time back bench 5 is returned to the original position.

After back bench 5 is returned to the original position, it is locked by a lock mechanism (not shown) in a state wherein it is movable in a drawing direction but is immovable in the lateral direction. Back bench 5 is moved forward by a hydraulic pressure until it abuts against die stand 71 provided to the rear end of carriage rail 7, and is vertically fixed to carriage rail 7. Thereafter, clamp 3 is moved forward toward the die, and guides the distal end of tube element a to the die in die stand 71.

After the distal end of tube element a is guided to the die, clamp arms 30 of clamp 3 are opened, and at the same time, the front end of tube element a is chucked by a chuck (not shown) of carriage 8. After tube element a is slightly drawn, plug rod 61 is moved forward by plug set device 50 toward the die so as to set plug 6 at the die position. Then, carriage 8 is moved forward in the drawing direction by hydraulic cylinder 72 shown in FIG. 1, thereby starting drawing.

In place of the above procedures, after the front end of tube element a is guided to the die and plug 6 is set at the die position, the drawing may be started.

Upon drawing, travel base 2 having holding mechanism 21 which holds the rear end of tube element a is drawn forward together with tube element a, and travels forward along back bench 5. Then, base 2 abuts against a stopper provided to the rear portion of die stand 71 and is stopped. In this embodiment wherein holding mechanism 21 holds the rear end of tube element a by the frictional force, the rear end of tube element is automatically released from holding mechanism 21 upon completion of drawing, i.e., when base 2 is stopped by the stopper.

Figure 6:
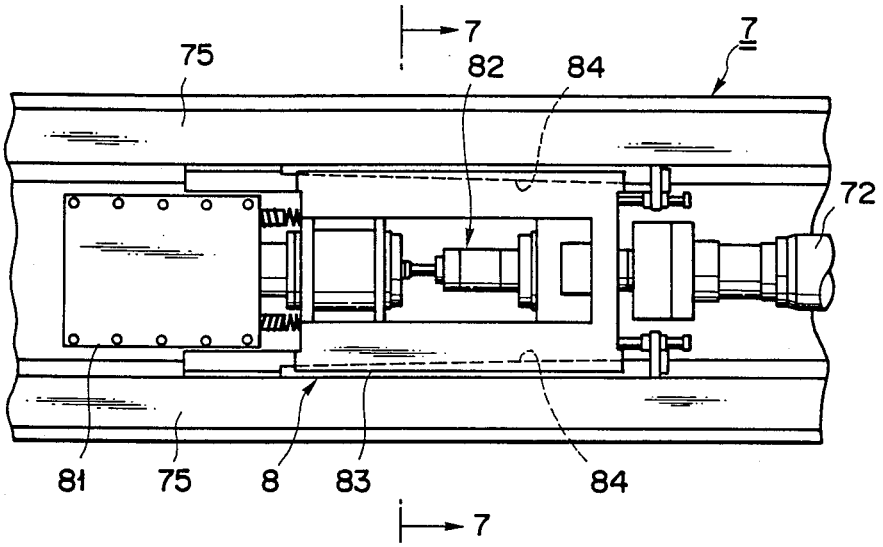
FIG. 6 is a side view showing a carriage and a carriage rail.

As shown in FIG. 6, shock absorber 82 for absorbing shock upon completion of drawing is provided behind chuck portion 81 of carriage 8.

Figure 7:
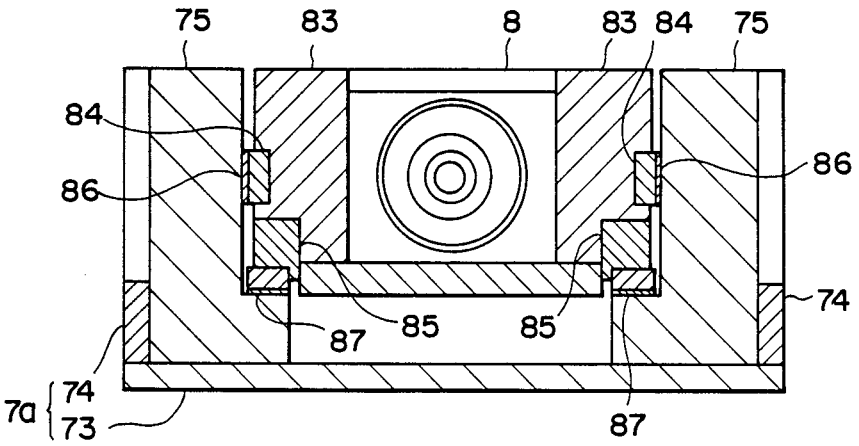
FIG. 7 is a sectional view taken along a line 7—7 in FIG. 6.

In this embodiment, carriage guide 7 is grooved, as shown in FIGS. 6 and 7, and is constituted such that a pair of opposing L-shaped rails 75 are fixed in groove frame 7*a* constituted by bottom plate 73 fixed on a base (not shown) and a pair of side frames 74 projecting from two sides of the bottom plate so as to be in contact with side frames 74.

Sliding blocks 84 and 85 are fixed to the vertical side surfaces and bottom portions of block frames 83 at two sides of carriage 8 so that sliding portions of blocks 84 and 85 project therefrom. The sliding portions of sliding blocks 84 and 85 are precisely finished with a metal such as iron with good machinability. Wear-resistive sheets 86 and 87 are adhered to the end faces of the sliding portions of blocks 84 and 85. Sliding blocks 84 on the side surfaces are brought into slidable contact with the inner vertical surfaces of rails 75, and sliding blocks 85 on the bottom portions are brought into slidable contact with the horizontal surfaces of the bottom portions of rails 75. In this manner, carriage 8 can travel along carriage rail 7 without being vibrated.

Sliding blocks 84 on the side surfaces of carriage 8 are embedded in block frames 83 while their inner surfaces are tapered internally forward (to the right in FIG. 6), in order to increase coupling strength in the drawing direction.

Sliding blocks 85 on the bottom portions may extend in a collar shape to the sides of block frames 83 to be slidable along the horizontal surfaces of the upper surfaces of rails 75.

Movable support mechanisms 9 are provided at predetermined intervals above carriage guide 7. Movable support mechanisms 9 are suspended, and are sequentially moved downward to horizontally support a tube (not shown) being drawn by carriage 8.

Figure 8:
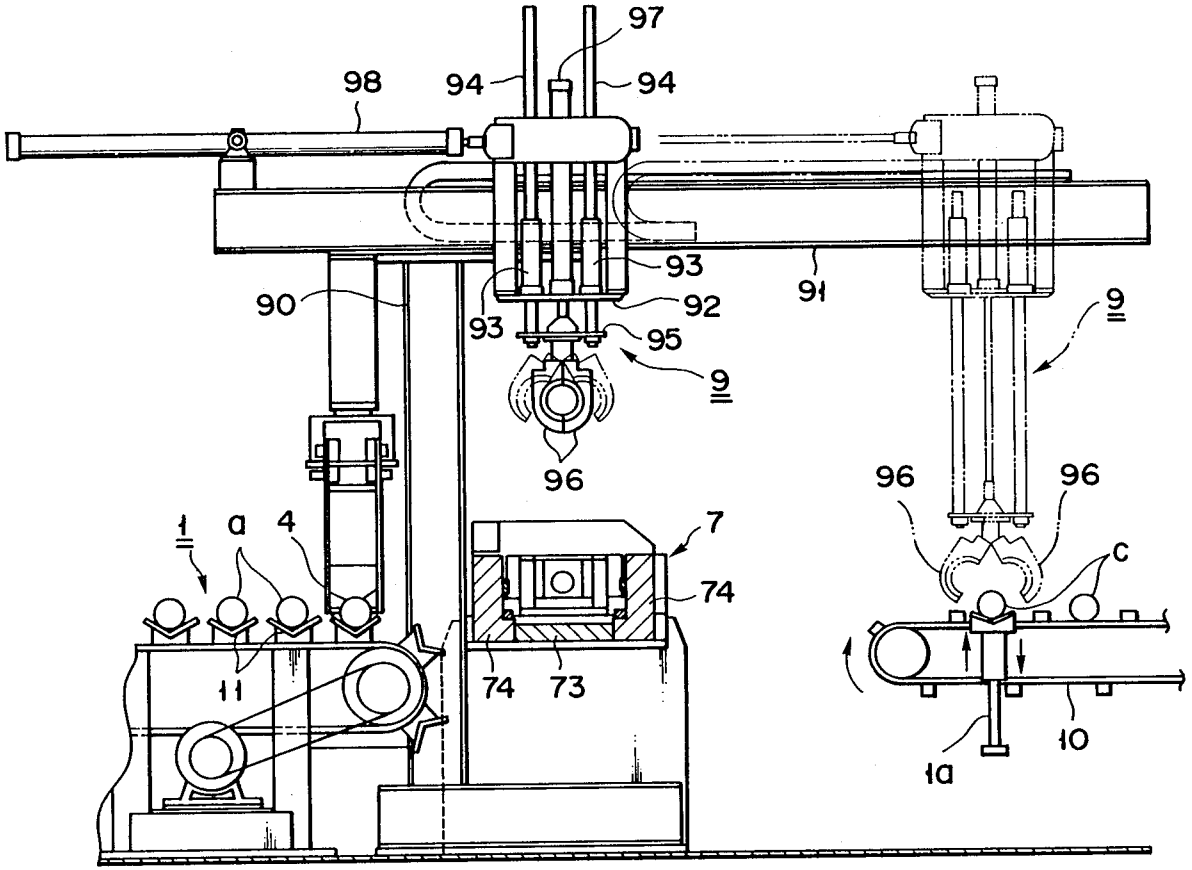
FIG. 8 is a sectional view taken along a line 8—8 in FIG. 1.

In this embodiment, each movable support mechanism 9 is arranged as follows. As shown in FIG. 8, guide rail 91 is horizontally fixed to column 90 vertically projecting near the side portion of carriage guide 7 to extend to a side opposite to feed conveyor 1. Shafts 94 are vertically movably provided, through a pair of guide cylinders 93, to travel base 92 which is movably mounted on guide rail 91, and base plate 95 is fixed to the lower end portions of shafts 94. In addition, a pair of arcuated or hook-like support segments 96 are mounted on the lower surface of base plate 95 to be openable/-closable facing down.

Support segments 96 in each movable support mechanism 9 are moved downward by pneumatic cylinder 97 arranged thereabove to a portion of a tube being drawn while they are opened facing down. Then, support segments 96 are closed by pneumatic cylinder 97 to lightly support the drawn tube from below.

In this manner, all the movable support mechanisms 9 support the drawn tube, drawing of a tube is completed, and the chuck of carriage 8 then releases the tube. Thereafter, mechanisms 9 are moved upward to their original positions by pneumatic cylinder 97 while supporting the drawn tube, and are moved to a position above right conveyor 10 along guide rail 91 by left pneumatic cylinder 98 in FIG. 8. Then, pairs of support segments 96 are moved downward immediately above conveyor 10, and are opened to gently place drawn tube c on lift 1*a*. Lift 1*a* is then slightly moved downward to feed tube c on conveyor 10, and at the same time, support segments 96 are moved upward and are returned to a position above carriage guide 7.

Cushion members such as porous members are preferably provided to the inner surfaces of support segments 96, the upper surface of lift 1*a*, and the surface of conveyor 10.

In the above embodiment, piping is made to appropriately supply a lubricant for lubrication during drawing to plug 6 and plug rod 61 in back bench 5 and the die.

In the above embodiment, travel base 2 may be arranged to be slid along rails 23 in the same manner as in carriage 8. Carriage 8 may be arranged to travel along rails 75 by rollers in the same manner as in travel base 2.

Support members 6*a* provided to back bench 5 and support members 2*a* provided to travel base 2 may be support members which have moderate V-shaped tube element receiving surfaces on the upper surfaces like lifter 12 and have cushion members are adhered to the receiving surface, instead of roller-like ones.

Back bench 5 in the above embodiment is horizontally moved to tube element fitting position b to be parallel to the original position. If the plug rod is substantially horizontally supported on back bench 5, back bench 5 and carriage guide 7 in front of it may be provided at higher levels than those in the above embodiment, so that tube element a is fed below carriage guide 7, and back bench 5 is moved vertically. Alternatively, a support shaft may be provided to an appropriate portion of back bench 5, so that back bench 5 is pivoted through a predetermined angle about the support shaft.

The drawing bench of this embodiment is used to draw a round tube, but may be similarly applied to deformed tubes such as a triangular tube, a rectangular tube, an elliptic tube, and the like. The drawing bench according to the present invention is best suitable for drawing Al and Al-based alloy tubes but may be applied to drawing of Cu-based and Fe-based metal tubes.

Using the drawing bench of the present invention and a conventional drawing bench, drawing was performed while drawing conditions such as an Al-alloy tube element material, a reduction of area, a drawing speed, a size of a drawn tube, and the like were changed, and the results of comparison of the outer-diameter roundness and bending of the obtained drawn tubes are summarized in Table 1 below.

TABLE 1

| DRAWING CONDITION | | | | PRESENT INVENTION | | PRIOR ART | |
|---|---|---|---|---|---|---|---|
| MATERIAL JIS | REDUCTION OF AREA (%) | DRAWING SPEED m/min | TUBE SIZE ϕxt (mm) | OUTER-DIAMETER ROUNDNESS μm | BENDING μm/300 mm | OUTER-DIAMETER ROUNDNESS μm | BENDING μm/300 mm |
| 6063 Al—Mg—Si—based alloy | 40 | 20 | 30 × 0.7 | 0 ~ 10 | 0 ~ 15 | 20 ~ 100 | 30 ~ 150 |
| 5056 Al—Mg—based alloy | " | " | " | 0 ~ 20 | 0 ~ 30 | 50 ~ 150 | 50 ~ 300 |
| 3003 Al—Mn—based alloy | 20 | " | " | 0 ~ 15 | 0 ~ 15 | 20 ~ 100 | 30 ~ 100 |
| " | 60 | " | " | 0 ~ 10 | 0 ~ 20 | 20 ~ 50 | 50 ~ 300 |
| " | 40 | 10 | " | 0 ~ 10 | 0 ~ 15 | 20 ~ 50 | 50 ~ 300 |
| " | " | 30 | " | 0 ~ 10 | 0 ~ 15 | 20 ~ 50 | 30 ~ 100 |
| " | " | 20 | " | 0 ~ 10 | 0 ~ 15 | 20 ~ 50 | 30 ~ 100 |
| " | " | " | 60 × 0.9 | 0 ~ 20 | 0 ~ 20 | 20 ~ 100 | 50 ~ 300 |
| " | " | " | 80 × 1.0 | 0 ~ 25 | 0 ~ 25 | 30 ~ 150 | 100 ~ 300 |
| " | " | " | 120 × 1.5 | 0 ~ 30 | 0 ~ 35 | 30 ~ 200 | 100 ~ 300 |

In Table 1, the outer-diameter roundness is a value obtained by subtracting the minimum outer diameter from the maximum outer diameter of the drawn tube, and bending represents a maximum bending amount (two ends of a tube are connected by a straight line, and a length from the straight line to a tube side surface of a maximum bent portion) measured when the drawn tube is cut into pieces each having a length of 300 mm.

As can be seen from Table 1, the drawing bench according to the embodiment of the present invention could manufacture a drawn tube which had higher dimensional precisions ten times that of the conventional drawing bench. No indentation or scratching was found on the surface of the tubular material, and the surface precision was good.

In a tubular material drawing apparatus according to the present invention, a tube element is horizontally held by a tube end holding mechanism and a clamp on a back bench to coincide with the drawing core. When the front end of the tube element is guided to a plug and during drawing, the tube element can be kept horizontal by a tube end holding mechanism, a die, and a carriage to coincide with the drawing core. In addition, a travel base and the carriage can travel without being vibrated. Therefore, tubes free from a nonuniform section and bending and having high dimensional precision such as outer-diameter roundness for a round tube can be mass-produced by drawing. Also a drawn tube having a high surface precision which is free from identation and scratching may be manufactured.

What is claimed is:

1. A tubular material drawing apparatus for manufacturing precision tubes comprising:

a back bench having guide means with an axis;

a plug set device, coupled to said back bench, for holding a plug rod parallel to said axis;

a travel base movable backward with respect to said back bench and guided by said guide means along said axis;

first holding means, couples to said travel base, for holding a rear end portion of a tube element and for moving the tube element parallel to said axis to fit the tube element on said plug rod upon movement of said travel base along said axis;

second holding means, separate from said first holding means, movably coupled said travel base parallel to said axis, for holding the rear end portion of the tube element and for bringing the rear end portion to said first holding means;

carriage guide means extending along said axis;

a carriage which is guided by said carriage guide means along said axis and which is movable in a forward direction;

die means provided between said block bench and said carriage, said die means including a die; and third holding means, coupled to said carriage, for holding a front end portion of the tube element;

said third holding means, said die, and said first holding means being coaxially positioned so that said third holding means holds the front end portion of the tube element while said first holding means holds the rear end portion of the tube element in which said plug rod is inserted, and while said carriage is moved forward, thereby allowing said die to draw the tube element.

2. An apparatus according to claim 1, wherein said carriage guide means has a pair of guide rails each having vertical and horizontal inner surfaces, said carriage has a pair of first sliding blocks which are in slidable contact with the vertical inner surfaces of said guide rails and a pair of second sliding blocks which are in slidable contact with the horizontal inner surfaces of said guide rails, and said carriage is slidable along said guide rails.

3. An apparatus according to claim 1, further comprising vibration prevention means for preventing vertical and horizontal vibrations of said travel base upon movement of said travel base with respect to said back bench.

4. An apparatus according to claim 3, wherein said vibration prevention means has tracks which are coupled to a bench base to extend along said axis parallel to each other, and have outer surfaces, and a pair of horizontal rollers and a pair of vertical rollers which are respectively coupled to said travel base to be rotatable about vertical and horizontal shafts, and are in rolling contact with the outer surfaces of said tracks.

5. An apparatus according to claim 1, further comprising moving means for moving said back bench in a direction perpendicular to said axis, and wherein said back bench is moved by said moving means between a first position at which the tube element is fitted on said plug rod and a second position at which the tube element in which the plug rod is inserted is subjected to drawing.

6. An apparatus according to claim 5, further comprising conveying means for sequentially and intermittently feeding the tube element to a position in front of the first position of said back bench, and means for pushing the tube element fed at the position in front of the first position toward said first holding means to fit the tube element on said plug rod.

7. An apparatus according to claim 1, wherein said back bench has a plurality of support members which are provided at predetermined intervals along said axis and which are movable between a first position at which said support members abut against said plug rod to support said plug rod and a second position at which said support members are separated from said plug rod to allow fitting of the tube element on said plug rod.

8. An apparatus according to claim 1, wherein said first holding means has a pair of chucks which abut against an inner surface at the rear end portion of the tube element for holding the tube element by frictional engagement, and openings which are formed in said chucks and through which said plug rod extends.

9. An apparatus according to claim 8, further comprising means, provided near said die means, for preventing forward movement of said travel base during drawing, and for allowing the tube element to be slid along said chucks to cancel the frictional engagement.

10. An apparatus according to claim 1, further comprising a plurality of movable support means, provided at predetermined intervals along said axis, for sequentially supporting portions of the tube element subjected to drawing.

* * * * *

UNITED STATES PATENT AND TRADEMARK OFFICE

CERTIFICATE OF CORRECTION

PATENT NO. : 4,860,568

DATED : August 29, 1989

INVENTOR(S) : YAMANOI et al

It is certified that error appears in the above-identified patent and that said Letters Patent is hereby corrected as shown below:

. In the title page, the name of the first inventor, "Tukio Yamanoi" should read --Yukio Yamanoi--.

Signed and Sealed this

Twenty-fifth Day of December, 1990

*Attest:*

HARRY F. MANBECK, JR.

*Attesting Officer*

*Commissioner of Patents and Trademarks*